United States Patent [19]

Chu

[11] Patent Number: 4,494,268

[45] Date of Patent: Jan. 22, 1985

[54] PAINT BRUSHES

[76] Inventor: Alan C. Chu, 2437 E. Lincoln Ave., Anaheim, Calif. 92806

[21] Appl. No.: 466,121

[22] Filed: May 2, 1983

[51] Int. Cl.[3] ..... A46B 7/04

[52] U.S. Cl. ..... 15/176; 15/202; 15/194

[58] Field of Search ..... 15/202, 145, 176, 244 R, 15/192, 193, 194; 403/329, 361; 16/114 R

[56] References Cited

U.S. PATENT DOCUMENTS

| | | | |
|---|---|---|---|
| D. 206,996 | 2/1967 | Blount | 15/176 X |
| 860,270 | 7/1907 | Trewhella | 81/177 A |
| 1,656,948 | 1/1928 | Mays | 15/147 R |
| 2,900,654 | 8/1959 | Koltvedt | 15/176 |
| 2,912,711 | 11/1959 | Hilton | 15/244 R |
| 3,076,989 | 2/1963 | Daw | 15/192 |
| 3,757,376 | 9/1973 | Coombes | 15/194 |
| 3,874,021 | 4/1975 | Jacobs | 15/176 X |
| 4,227,276 | 10/1980 | Ginsburg et al. | 15/176 |
| 4,319,379 | 3/1982 | Carrigan et al. | 15/176 |

*Primary Examiner*—Peter Feldman

[57] ABSTRACT

A paint brush comprises a handle (1) and a bristle portion (2) detachably secured to the handle (1). The bristle portion consists of bristles (5) fixedly mounted in a retaining member (4) which is received in a hollow portion (11) of the handle. A pair of resilient arms (6) are provided on the retaining member and are formed with projections (8) which engage in the hollow portion of the handle.

2 Claims, 16 Drawing Figures

A
B
C
1
2
3
4
5
6
7
8
9
10
11
12
13
14
15

D
E
F
1
2
3
4
5
6
8
9
10
11
12
13
15
16
18

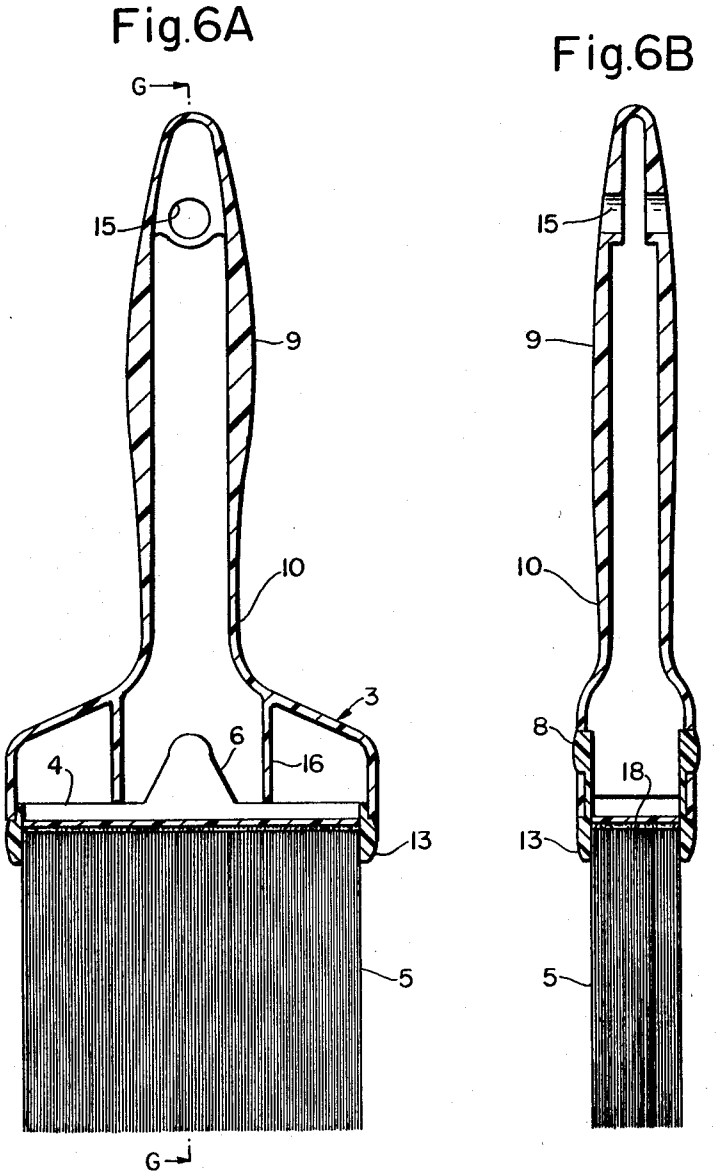
Fig.6A
G
15
9
10
3
16
6
4
13
5
G
Fig.6B
15
9
10
8
18
13
5
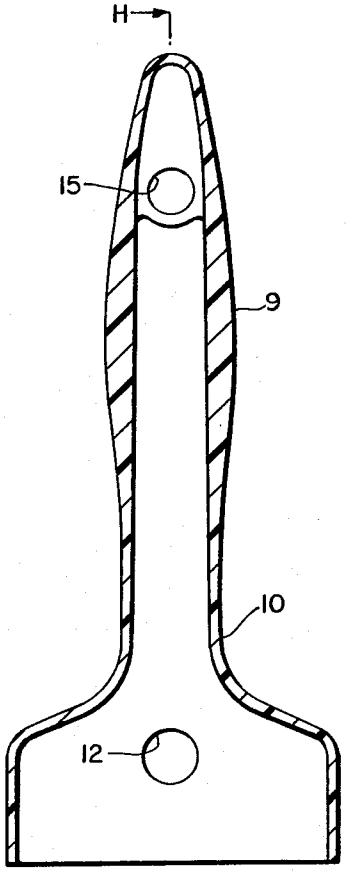
Fig.7A
H
15
9
10
12
H
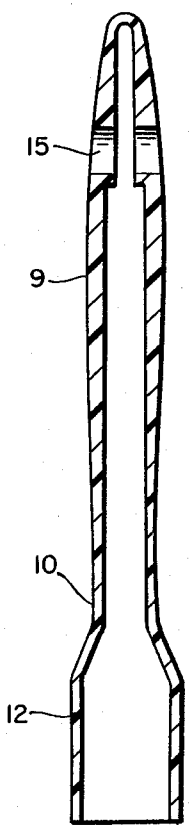
Fig.7B
15
9
10
12

PAINT BRUSHES

This invention relates to improvements in or relating to paint brushes.

During the lifetime of a conventional paint brush, the bristles may become damaged and render the brush unusable. Such a situation may occur through wear or if the bristles become clogged with paint which cannot be removed as a result, for example, of the brush not having been cleaned immediately after use or having been improperly cleaned.

It is an object of the present invention to provide an improved paint brush and accordingly the invention provides a paint brush comprising a handle and a bristle portion detachably secured to the handle.

Preferably, the bristle portion of a brush constructed in accordance with the invention is removably mounted in the handle.

In a preferred embodiment, the bristles of the bristle portion are fixedly mounted in a retaining member which is removably mounted in a hollow portion of the handle. Conveniently, the retaining member is formed with a pair of resilient arms extending away from and outwardly of the bristles such that, when the bristle portion is mounted in the handle, each arm engages in a respective aperture formed through the wall of the hollow portion of the handle.

In order that the invention may be readily understood, embodiments thereof will now be described, by way of example, with reference to the accompanying drawings, in which:

FIG. 6A is a cross-sectional view of the handle of FIG. 5A which is similar to FIG. 5A and shows the mounting of the bristle portion in the handle; and FIG. 6B is a cross-sectional view taken along line G—G of FIG. 6A showing the mounting of the bristle portion in the handle of FIG. 6A.

FIG. 7A is a cross-sectional view of an alternative handle similar to the handle of FIG. 2A but completely hollow;

FIG. 7B is a cross-sectional view taken along line H—H of FIG. 7A of the handle of FIG. 7A Referring now to the drawings, FIGS. 1A to 4B, show a paint brush embodying the invention.

Figures 1A, 1B, 1C, 1D, 2A, 2B:
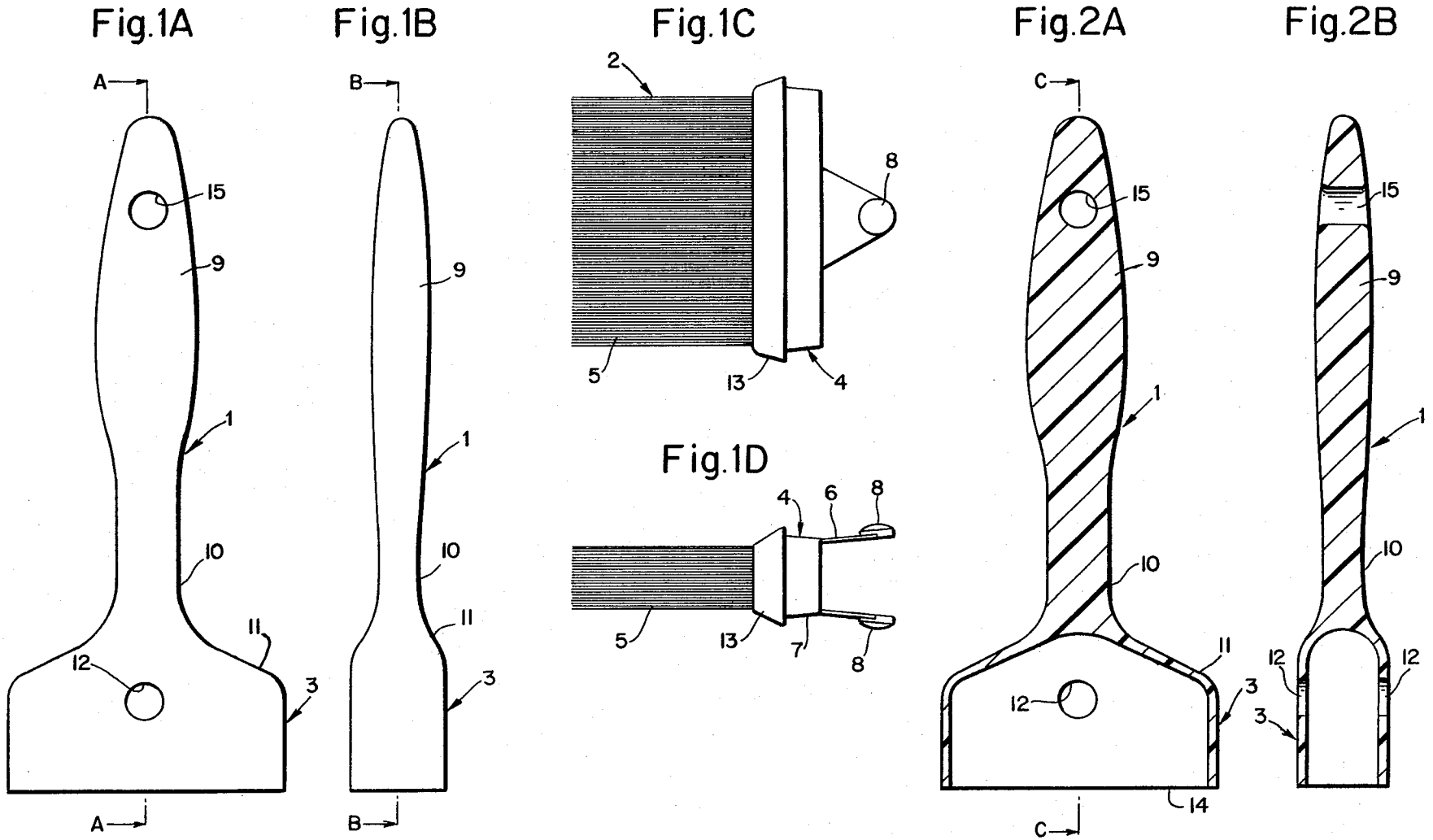
FIG. 1A is a front view of a handle of a paint brush embodying the invention.
FIG. 1B is a side view of the handle of FIG. 1A.
FIG. 1C is a front view of a bristle portion of a paint brush embodying the invention.
FIG. 1D is a side view of the bristle portion of FIG. 1C.
FIG. 2A is a cross-sectional view of the handle of FIGS. 1A and 1B taken along line B—B of FIG. 1B.
FIG. 2B is a cross-sectional view of the handle of FIGS. 1A and 1B taken along line A—A of FIG. 1A.

The paint brush comprises a handle 1, preferably moulded from a plastics material or light metal and a bristle portion 2 which is removably mounted in a hollow portion 3 of the handle as can be seen from FIGS. 1A to 4B.

The bristle portion 2 comprises a retaining member 4 preferably made of plastics material in which the bristles 5 which may be made of a natural or synthetic material are fixedly mounted.

The retaining member 4 is in the form of an open tubular body of generally rectangular cross-section in which the bristles 5 are fixed by glue 18 at the inner end. A pair of resilient arms 6 extend from the elongate surfaces 7 of the retaining member 4 away from the bristles. Each resilient arm 6 is generally triangular in shape and is formed with a projection 8 at the free end thereof. As can be seen from FIG. 1D the arms 6 diverge outwardly from the retaining member 4.

As shown in FIGS. 2A and 2B, the handle 1 is formed by an elongate bulbous portion 9 connected via a relatively narrow neck 10 to an enlarged hollow portion 11 in which the bristle portion is removably mounted. Apertures 12 are formed in opposing portions of the wall of the hollow portion 11 to receive the projections 8 on the arms 6 of the retaining member so that, when the retaining member is mounted within the hollow portion 11, a flange 13 formed on the retaining member abuts the free edge 14 of the hollow portion 11.

An aperture 15 may be formed through the free end of the elongate bulbous portion of the handle to allow the handle and any bristle portion mounted thereon to be hung on, for example, a hook in a storage cupboard.

Figures 3A, 3B, 4A, 4B, 5A, 5B:
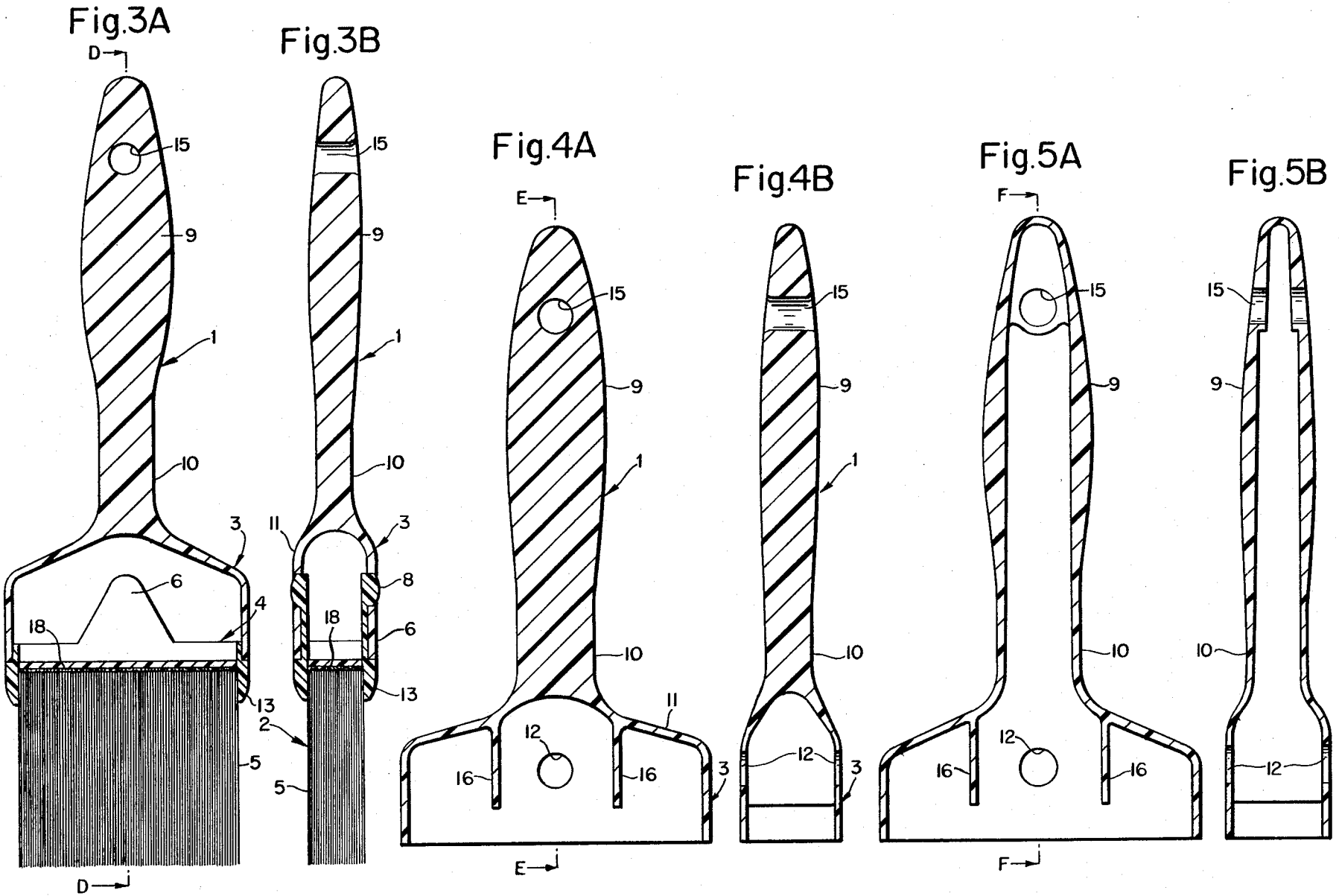
FIG. 3A is a cross-sectional view of the handle similar to FIG. 2A showing the mounting of the bristle portion in the handle.
FIG. 3B is a cross-sectional view taken along line D—D of FIG. 3A of the handle and bristle portion.
FIG. 4A is a cross-sectional view similar to FIG. 2A of an alternative handle suitable fo use with a larger bristle portion than the handle of FIG. 2A.
FIG. 4B is a cross-sectional view of the alternative handle of FIG. 4A taken along line E—E of FIG. 4A
FIG. 5A is a cross-sectional view of an alternative handle similar to the alternative handle of FIG. 4A but completely hollow.
FIG. 5B is a cross-sectional view taken along line F—F of FIG. 5A of the handle of FIG. 5A.

FIGS. 4A and 4B show a handle for a larger paint brush, for example a 3"(7.6 cm) or larger paint brush.

The handle shown in FIGS. 4A and 4B is substantially similar to that described above, except that strengthening ribs 16 extend into the hollow portion of the handle in which the bristle portion is to be mounted.

FIGS. 5A and 5B show an alternative construction of the handle of FIGS. 4A and 4B, wherein substantially the whole of the handle is hollow to reduce weight and manufacturing costs.

The bristle portion of the larger paint brush is substantially identical to that shown in FIGS. 1C and 1D but is of course of larger dimensions so as to fit the larger handle.

In order to remove the bristle portion 2 from the handle 1 of a paint brush embodying the invention, pressure is applied to the projections 8 of the resilient arms 6 through the apertures 12 to force the projections 8 out of engagement with the apertures and the bristle portion 2 is pulled away from the handle using the flange 13. To inert a new bristle portion, the resilient legs 6 are first squeezed together to enable the projections 8 to enter the hollow bristle portion receiving part of the handle and then the bristle portion is forced upwardly into the handle by applying pressure on the flange 13 until the projections 8 reach the apertures 12 whereupon the arms 6 spring outwardly to engage the projections 8 in the apertures 12.

Accordingly, a damaged or permanently soiled bristle portion may be simply removed and replaced by a new bristle portion and thus the whole paint brush need not be discarded when the bristle portion is no longer fit for use. Further, provided that the retaining member is of the correct shape to fit inside the handle, any number of different bristle portions having differently shaped bristle arrangements may be used in conjunction with a single handle, the particular bristle portion chosen depending upon the particular qualities required of the paint brush in the work to be performed.

I claim:

1. A paint brush comprising a handle and a bristle portion detachably secured to said handle, said handle having an open hollow wall portion at the end adjacent said detachable bristle portion, said hollow wall portion of the handle having two apertures formed in and through said wall portion, each aperture formed opposite to each other, the bristles of the bristle portion being fixedly mounted in a retaining member which is removably mounted within said hollow wall portion of the handle, said retaining member being formed with a pair of opposing resilient arms, each arm being formed at each free end thereof with a transversely extending projection, said arms extending upwardly away from and outwardly from the extent of the bristles such that when the retaining member is mounted within said hollow handle portion, the arms spring outwardly and each projection respectively engages into each aperture of said wall portion, and when pressure is inwardly applied to said projections through said apertures so that each projection is forced out of engagement therewith, the bristle portion may be removed from within said hollow wall portion of said handle.

2. A paint brush according to claim 1, wherein the hollow wall portion of said handle has a free edge, and a flange is formed around said retaining member and abuts the free edge when the retaining member is mounted within said hollow wall portion.

* * * * *